US008031215B2

(12) United States Patent
Koyama et al.

(10) Patent No.: US 8,031,215 B2
(45) Date of Patent: Oct. 4, 2011

(54) THERMAL HEAD, THERMAL PRINTER AND MANUFACTURING METHOD OF THERMAL HEAD

(75) Inventors: Noboru Koyama, Tokyo (JP); Mitsuo Yanase, Kanagawa (JP); Toru Morikawa, Kanagawa (JP); Kazunori Onuma, Miyagi (JP)

(73) Assignee: Sony Corporation, Tokyo (JP)

( * ) Notice: Subject to any disclaimer, the term of this patent is extended or adjusted under 35 U.S.C. 154(b) by 437 days.

(21) Appl. No.: 12/320,549

(22) Filed: Jan. 29, 2009

(65) Prior Publication Data

US 2009/0201355 A1 Aug. 13, 2009

(30) Foreign Application Priority Data

Feb. 7, 2008 (JP) ..... 2008-028135

(51) Int. Cl.
*B41J 2/335* (2006.01)

(52) U.S. Cl. ..... 347/202; 347/206

(58) Field of Classification Search ..... 347/200–208
See application file for complete search history.

(56) References Cited

U.S. PATENT DOCUMENTS 4,742,362 A * 5/1988 Takoshima et al. ..... 347/202
6,753,893 B1 * 6/2004 Kitazawa ..... 347/206
6,822,665 B2 * 11/2004 Sugiyama et al. ..... 347/200
7,843,476 B2 * 11/2010 Morikawa et al. ..... 347/209
2007/0257980 A1 11/2007 Koyama et al.

FOREIGN PATENT DOCUMENTS

JP 61-283573 * 12/1986
JP 02-121851 A 5/1990
JP 2007-245675 9/2007
JP 2007-283645 A 11/2007

OTHER PUBLICATIONS

Japanese Office Action issued Nov. 10, 2009 for corresponding Japanese Application No. 2008-028135.
Japanese Office Action issued Jun. 22, 2010 for corresponding Japanese Application No. 2008-028135.

* cited by examiner

*Primary Examiner* — Julian Huffman
*Assistant Examiner* — Sharon A Polk
(74) *Attorney, Agent, or Firm* — Rader, Fishman & Grauer PLLC

(57) ABSTRACT

A thermal head which forms an image on a recording medium by pressing a protruding portion on which heating elements are arranged on the recording medium while driving the heating elements to be heated includes a support substrate in which a concave gap portion facing the protruding portion is formed and a glaze layer provided on the support substrate and in which the protruding portion is formed, in which the glaze layer has a base layer stacked on the support substrate as well as forming a ceiling surface of the gap portion and a heat resistant layer stacked on the base layer and on which the heating elements are arranged.

7 Claims, 11 Drawing Sheets

THERMAL HEAD, THERMAL PRINTER AND MANUFACTURING METHOD OF THERMAL HEAD

CROSS REFERENCE TO RELATED APPLICATIONS

The present invention contains subject matter related to Japanese Patent Application JP 2008-028135 filed in the Japanese Patent Office on Feb. 7, 2008, the entire contents of which being incorporated herein by reference.

BACKGROUND OF THE INVENTION

1. Field of the Invention

The invention relates to a thermal head, a thermal printer and a manufacturing method of the thermal head which form an image on a recording medium by pressing a protruding portion on which heating elements are arranged on the recording medium while driving heating elements to be heated. Particularly, the invention relates to a technique for improving heat resistance, breaking strength and processing accuracy of the thermal head.

2. Description of the Related Art

A thermal printer including a thermal head having heating resistive elements (heating elements) are arranged on a protruding portion and a platen roller provided so as to face the thermal head is conventionally known. Such a thermal printer forms an image by pressing the protruding portion of the thermal head on the printing paper (recording medium) carried on the platen roller. The protruding portion and the printing paper are pressed by moving the thermal head or the platen roller.

The thermal printer has a sublimation method, a heat sensitive method and the like as an image forming method. In any method, power is selectively applied to the heating resistive elements of the thermal head according to the tone level, and the image is formed by using thermal energy generated at that time. For example, in the case of a sublimation-type thermal printer, when the protruding portion of the thermal head is pressed on the printing paper through an ink ribbon and the heating resistive elements are driven to be heated, ink on the ink ribbon is sublimed on the printing paper in proportion to thermal energy of the heating resistive elements to perform printing.

As described above, the thermal head heats the heating resistive elements for performing printing, and most of the heat generated from the heating resistive elements at the time of printing is transmitted in the opposite direction of the printing paper and released. Therefore, in order to print at high speed, it is necessary to heat the heating resistive elements at high temperature immediately, however, there arises a problem that power consumption increases. Since it is necessary to increase a printing speed while saving power particularly in a thermal printer for home use, it is desirable to improve thermal efficiency of the thermal head to reduce power consumption.

A technique of improving thermal efficiency and response of the thermal head in order to reduce power consumption of the thermal printer as well as to print high quality images or characters at high speed is known. Specifically, in the technique, a gap portion is formed in a glass substrate in which heating resistive elements are arranged, and an air layer in the gap portion makes heat generated from the heating resistive elements difficult to be released in the direction of the glass substrate to improve thermal efficiency as well as the gap portion reduces the heat accumulation amount of the glass substrate to improve response (For example, refer to JP-A-2007-245675 (Patent Document 1)).

FIG. 11 is a longitudinal sectional view showing a thermal head 110 in related art, which is disclosed in the Patent Document 1.

As shown in FIG. 11, in the thermal head 110, a heating resistive element 112, a power supply electrode 113*a* and a drive electrode 113*b* for heating the heating resistive element 112 and a protective film 114 for protecting the heating resistive element 112, the power supply electrode 113*a* and the drive electrode 113*b* are sequentially stacked on a glass substrate 111 on which a protruding portion 111*a* having an approximately arc-shape in vertical section is formed. A portion between the power supply electrode 113*a* and the drive electrode 113*b*, in which the heating resistive element 112 is exposed, is a heating portion 112*a* which actually generates thermal energy.

The heating portion 112*a* is provided on the protruding portion 111*a* so that the heating portion 112*a* can be pressed on the ink ribbon and the printing paper. In the glass substrate 111 on which the protruding portion 111*a* is formed, a concave gap portion 111*b* which faces the protruding portion 111*a* is also formed. The gap portion 111*b* is filled with air. Furthermore, a heatsink 115 adheres to the bottom of the glass substrate 111 by an adhesive 116 so as to close an opening surface of the gap portion 111*b*.

In the above thermal head 110, thermal conductivity in the gap portion 111*b* is low due to characteristics of air having lower thermal conductivity than glass forming the glass substrate 111. Therefore, since heat release from the heating portion 112*a* provided on the protruding portion 111*a* of the glass substrate 111 to the direction of the glass substrate 111 is suppressed, thermal energy transmitted in the direction the ink ribbon pressed by the protruding portion 111*a* is increased. As a result, power consumption which is necessary for increasing a temperature of ink on the ink ribbon to the sublimation temperature of the ink at the time of printing is reduced, which improve thermal efficiency of the thermal head 110.

Additionally, the thickness of the protruding portion 111*a* of the glass substrate 111 is reduced by the gap portion 111*b* and the heat accumulation amount of the glass substrate 111 is reduced, therefore, thermal energy accumulated in the glass substrate 111 can be released in a short time. As a result, when ink on the ink ribbon is not sublimed (when the heating portion 112*a* is not heated, the temperature of the heating portion 112*a* decreases immediately, which improves response of the thermal head 110.

SUMMARY OF THE INVENTION

However, it is demanded that power consumption is further reduced and printing is performed at high speed even in the thermal head 110 shown in FIG. 11. In order to realize the above, it is necessary not only to further improve thermal efficiency and response but also to improve heat resistance and breaking strength of the protruding portion 111*a* which will be exposed to high temperature just under the heating portion 112*a* of the thermal head 110. Additionally, since the strength of the glass substrate 111 is reduced due to the formation of the gap portion 111*b*, it is necessary to improve processing accuracy of the gap portion 111*b* so that reduction of the strength of the protruding portion 111*a* exposed to high temperature is prevented as much as possible.

Accordingly, it is desirable to improve heat resistance, breaking strength and processing accuracy of the thermal head as well as to obtain good thermal efficiency and response to reduce power consumption and to realize high-speed printing.

According to an embodiment of the present invention, there is provided a thermal head which forms an image on a recording medium by pressing a protruding portion on which heating elements are arranged on the recording medium while driving the heating elements to be heated, including a support substrate in which a concave gap portion facing the protruding portion is formed and a glaze layer provided on the support substrate and in which the protruding portion is formed, in which the glaze layer has a base layer stacked on the support substrate as well as forming a ceiling surface of the gap portion, and a heat resistant layer stacked on the base layer and on which the heating elements are arranged.

According to an embodiment of the invention, there is provided a thermal printer including a thermal head which forms an image on a recording medium by pressing a protruding portion on which heating elements are arranged on the recording medium while driving the heating elements to be heated, in which the thermal head has a support substrate in which a concave gap portion facing the protruding portion is formed and a glaze layer provided on the support substrate and in which the protruding portion is formed, in which the glaze layer has a base layer stacked on the support substrate as well as forming a ceiling surface of the gap portion and a heat resistant layer stacked on the base layer and on which the heating elements are arranged.

(Operation)

According to an embodiment of the invention, the support substrate in which the concave gap portion facing the protruding portion on which the heating elements are arranged is formed and the glaze layer provided on the support substrate and in which the protruding portion is formed. The glaze layer is stacked on the support substrate, including the base layer forming the ceiling surface of the gap portion and the heat resistant layer which is stacked on the base layer and on which the heating elements are arranged. Accordingly, the heat resistance of the thermal head is improved by the heat resistant layer. Also, the dimension accuracy of the gap portion is improved by the base layer as well as microcracks do not occur in the glaze layer on the gap portion, which improves braking strength.

According to an embodiment of the invention, there is provided a manufacturing method of a thermal head having a glaze layer on a support substrate, in which a protruding portion on which heating elements are arranged is formed, which forms an image on a recording medium by pressing the protruding portion on which the heating elements are arranged on the recording medium while driving the heating elements to be heated, including the steps of forming a base layer to be a lower layer in the glaze layer on the support substrate including a protrusion corresponding to the protruding portion, forming a heat resistant layer on the base layer formed in the step of forming the base layer, which is to be an upper layer in the glaze layer and on which the heating elements are arranged and forming a concave gap portion facing the protruding portion and whose ceiling surface is the base layer on the support substrate by exposing the base layer on the protrusion after forming the base layer in the step of forming the base layer.

(Operation)

According to an embodiment of the invention, the manufacturing method of the thermal head having the blaze layer on the support substrate, in which the protruding portion on which the heating elements are arranged is formed includes the step of forming the base layer to be a lower layer of the glaze layer, the process of forming the heat resistant layer to be the upper layer of the glaze layer on the base layer, on which the heating elements are arranged and the step of forming the gap portion forming the concave gap portion facing the protruding portion and whose ceiling surface is the base layer. Accordingly, the heat resistance of the thermal head is improved by the heat resistant layer formed in the step of forming the heat resistant layer. Also, since the base layer functions as a barrier when forming the gap portion in the step of forming the gap portion, processing accuracy of the gap portion is improved as well as microcracks and the like do not occur in the glaze layer on the gap portion, which improves breaking strength.

According to an embodiment of the invention, the heat resistance of the thermal head is improved by the heat resistant layer which is the upper layer of the glaze layer. Also, the accuracy (dimension accuracy and processing accuracy) of the gap portion in the support substrate is improved as well as microcracks and the like do not occur in the glaze layer on the gap portion and breaking strength is improved by the base layer which is the lower layer of the glaze layer. Accordingly, it is possible to form the gap portion to be large and to make the thickness of the glaze layer on the gap portion to be thinner. As a result, it becomes further difficult to release heat of the heating elements in the direction of the support substrate due to the air layer in the large gap portion, which further improves thermal efficiency. Furthermore, the heat accumulation amount in the support substrate and the glaze layer is further reduced and heat release can be performed easily due to the large gap portion and the thin glaze layer, which further improves response. Therefore, not only power consumption can be reduced but also high-speed printing becomes possible.

DESCRIPTION OF THE PREFERRED EMBODIMENTS

Hereinafter, embodiments of the invention will be explained with reference to the drawings.

Figure 1:
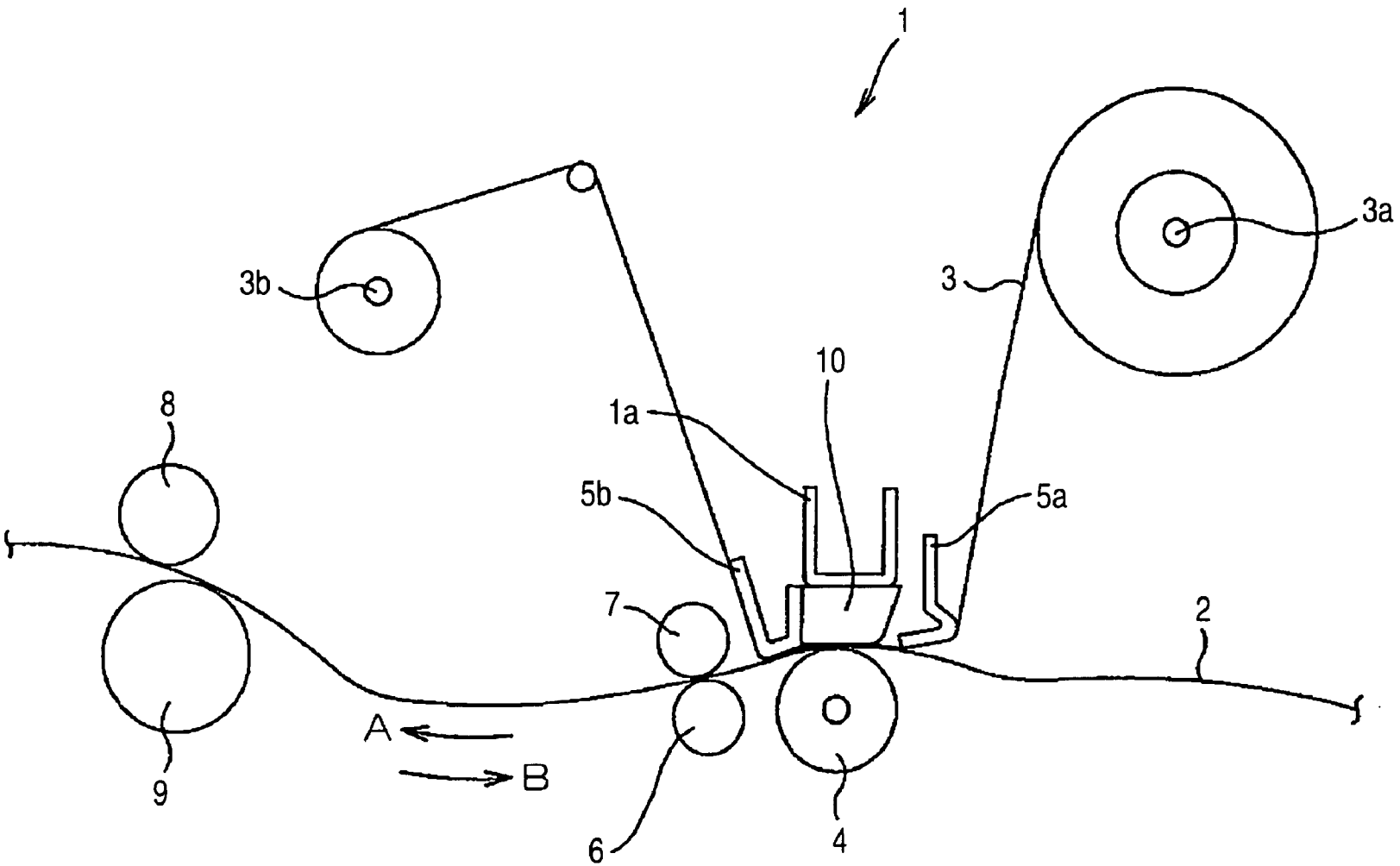
FIG. 1 is a side view showing a thermal printer including a thermal head according to a first embodiment.

FIG. 1 is a side view of an outline showing a thermal printer 1 including a thermal head 10 according to a first embodiment.

Figure 2:
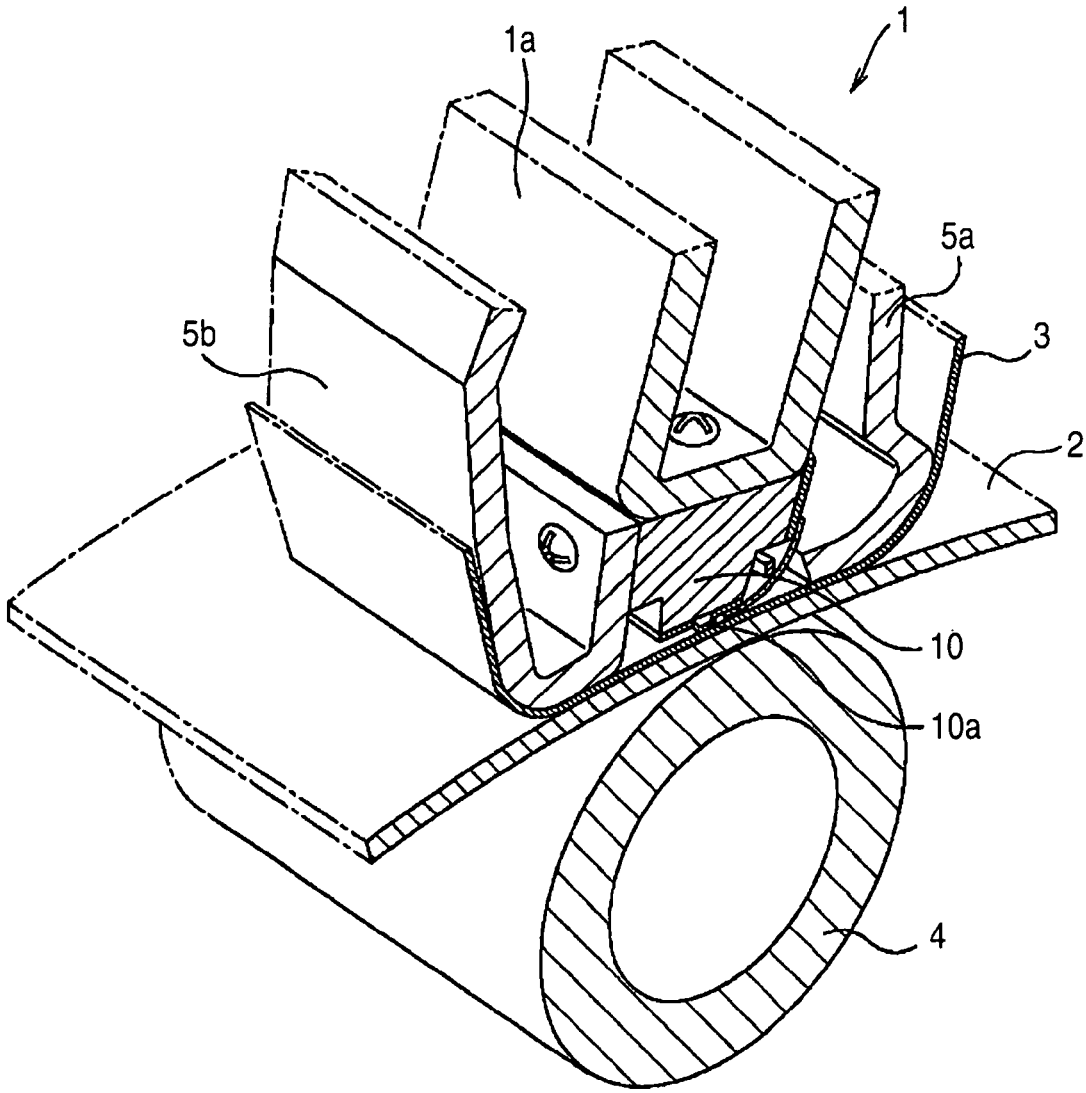
FIG. 2 is a perspective view showing the periphery of the thermal head according to the first embodiment.

FIG. 2 is a perspective view showing the periphery of the thermal head 10 according to the first embodiment.

As shown in FIG. 1 and FIG. 2, the thermal printer 1 is a sublimation type printer which forms an image on a printing paper 2 (recording medium) by subliming ink on an ink ribbon 3. Specifically, the thermal printer 1 prints color images or characters on the printing paper 2 by subliming ink on the ink ribbon 3 by thermal energy generated by the thermal head 10.

The thermal printer 1 includes the thermal head 10, a platen roller 4 provided at a position facing the thermal head 10, ribbon guides 5*a*, 5*b* which guide running of the ink ribbon 3, a capstan roller 6 which carries the printing paper 2 pressed between the thermal head 10 and the platen roller 4, a pinch roller 7 which driven-rotates, facing the capstan roller 6, a delivery roller 8 which delivers the printing paper 2 after printing and a carrying roller 9 which carries the printing paper 2 in the opposite direction, namely, toward the thermal head 10. The thermal head 10 is attached to a fixing member 1*a* in a casing side of the thermal printer 1.

Here, the ink ribbon 3 is formed by a long resin film, which is housed in an ink cartridge in a state of being wound between a supply spool 3*a* and a winding spool 3*b* as shown in FIG. 1. On one surface of the resin film, three inks of Y (yellow), M (magenta) and C (cyan), and laminate ink for improving storage stability of the printed images or characters are coated repeatedly. The ink ribbon 3 is guided between the thermal head 10 and the platen roller 4 by the ribbon guides 5*a*, 5*b* provided in the supplying side and the winding side of the ink ribbon 3 with respect to the thermal head 10.

In order to perform printing by the above thermal printer 1, the printing paper 2 and the ink ribbon 3 are pressed between a head portion 10*a* of the thermal head 10 and a platen roller 4 as shown in FIG. 2. Then, the winding spool 3*b* shown in FIG. 1 is rotated to allow the ink ribbon 3 to run in the winding direction (left direction in FIG. 1). Further, the printing roller 2 sandwiched between the capstan roller 6 and the pinch roller 7 in the delivery direction (direction of an arrow A in FIG. 1) by rotating the capstan roller 6 and the delivery roller 8. When thermal energy is added to the ink ribbon 3 from the thermal head 10 in this state, ink of Y (yellow) overlapping the printing paper 2 is sublimed and transferred on the printing paper 2.

Next, ink of M (magenta) is transferred on an image forming portion on the printing paper 2 on which ink of Y (yellow) is transferred. For the transfer, the carrying roller 9 is rotated to carry the printing paper 2 backward in the direction of the thermal head 10 (direction of an arrow B in FIG. 1) so as to be returned to a position where a starting edge of image formation on the printing paper 2 faces the thermal head 10. Further, ink of M (magenta) of the ink ribbon 3 is made to face the thermal head 10. Then, in the same manner when the ink of Y (yellow) is transferred, thermal energy is added to the ink ribbon 3 from the thermal head 10 while carrying the printing paper 2 in the delivery direction (direction of the arrow A in FIG. 1), subliming ink of M (magenta) to be transferred on the printing paper 2. Further, in the same manner when the ink of M (magenta) is transferred, ink of C (Cyan) and laminate ink are sequentially transferred on the printing paper 2 to print color images and characters as well as to improve the storage stability of images and the like, then, the printing paper 2 is delivered by the delivery roller 8.

Figure 3:
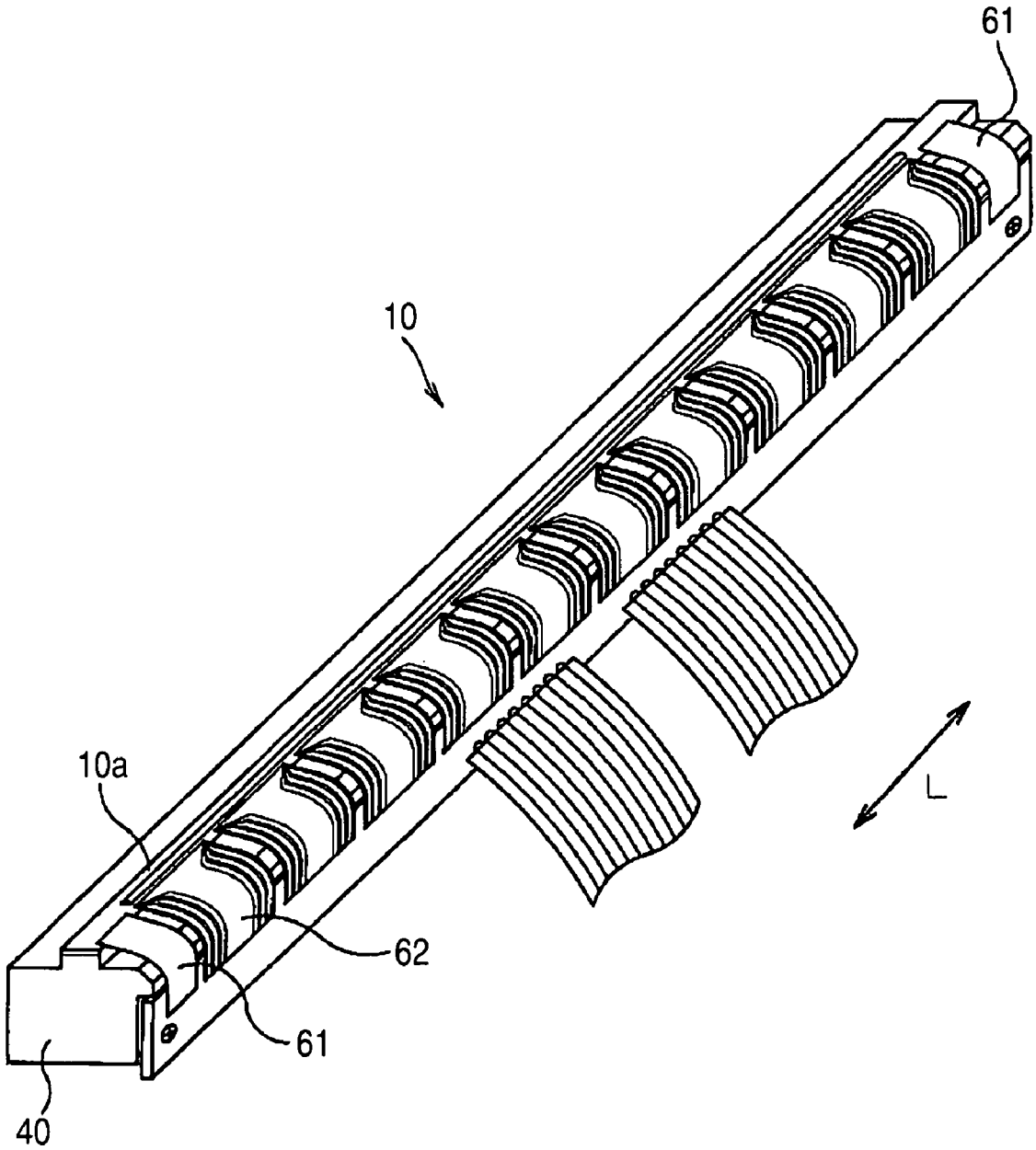
FIG. 3 is a perspective view showing the whole thermal head according to the first embodiment.

FIG. 3 is a perspective view showing the whole thermal head 10 according to the first embodiment.

Figure 4:
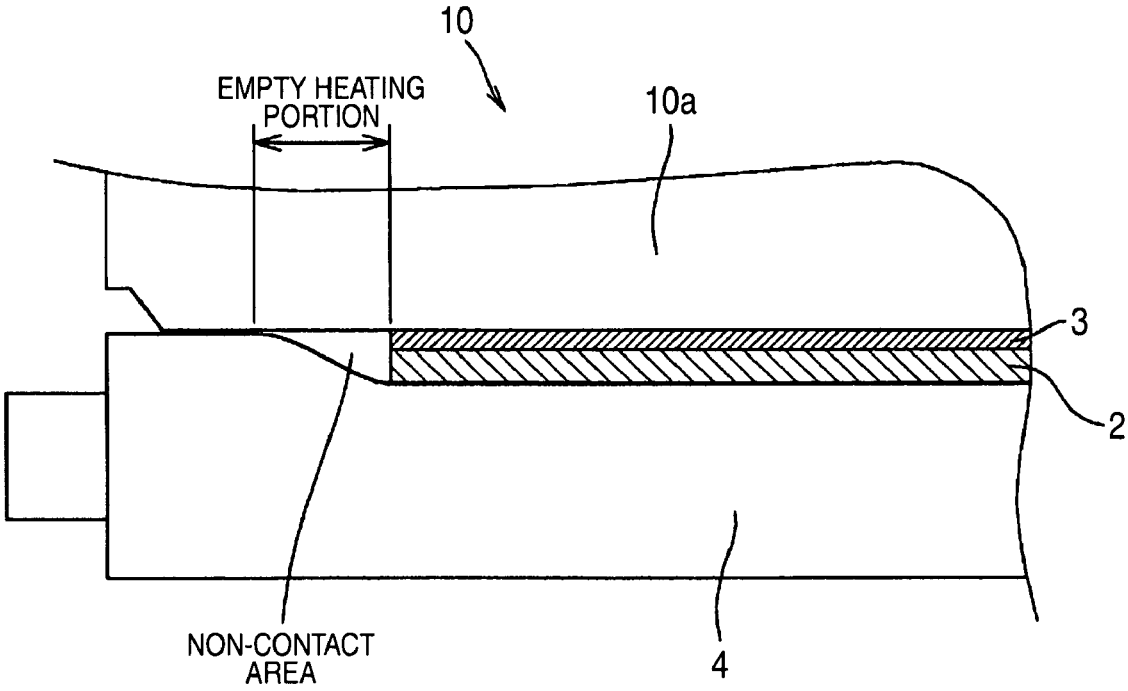
FIG. 4 is a front view showing a state in which a printing paper and an ink ribbon are pressed between the thermal head according to the first embodiment and the platen roller.

FIG. 4 is a front view showing a state in which the printing paper 2 and the ink ribbon 3 are pressed between the thermal head 10 according to the first embodiment and the platen roller 4.

As shown in FIG. 3, in the thermal head 10, a heatsink 40 as a member of releasing generated heat is adhered to the head portion 10*a* which generates thermal energy. That is, excess heat of the head portion 10*a* is released to the heatsink 40 when the printing is not performed. An adhesive 50 (not shown) for the heatsink 40 includes a filler and the like having thermal conductivity.

In order to form an image by the thermal head 10, flexible substrates for power supply 61 in which one end is electrically connected to the head portion 10*a* and the other end is connected to the power supply are provided at both ends of the head portion 10*a*. Furthermore, plural flexible substrates for driving 62 in which one end is electrically connected to the head portion 10*a* and the other end is electrically connected to a control circuit are arranged between the flexible substrates for power supply 61 at both ends of the head portion 10*a*. The flexible substrates for power supply 61 and the flexible substrates for driving 62 are connected interposing a film made of an insulating resin material including conductive particles (for example, ACF: anisotropic conductive film) between these substrates and the head portion 10*a*.

The head portion 10*a* has the width wider than the width of the printing paper 2 in a direction (direction of an arrow L in FIG. 3) orthogonal to the carrying direction of the printing paper 2 (refer to FIG. 4). Therefore, an image with no margin in which there is no blank space at both ends of the printing paper 2 in the width direction can be formed.

However, when the head portion 10*a* has the width wider than the width of the printing paper 2, a non-contact area is generated at an end of the head portion 10*a*, in which the end of the head portion 10*a* does not touch any of the printing paper 2, the ink ribbon 3 and the platen roller 4.

In this the non-contact area, thermal energy of the head portion 10*a* is not transmitted to the ink ribbon 3 and the like, and the area will be an empty heating portion of the head portion 10*a* in which heat release is difficult due to airspace of the non-contact area. Accordingly, temperature in the head portion 10*a* is locally increased at the empty heating portion. Particularly, the temperature at the head portion 10*a* is high by increasing power consumption in recent years when high-speed printing is demanded, therefore, the temperature increase at the empty heating portion also tends to be strong. Then, the heat-resistant temperature of the head portion 10*a* exceeds and a fear of causing destruction occurs, which incurs problems of durability and reliability of the head portion 10*a*. The non-contact area shown in FIG. 4 is also generated by interfusion of foreign materials under the head portion 10*a* during printing and the like, not only at the end portion of the head portion 10*a*.

Accordingly, the heat resistance of the head portion 10*a* is improved, thereby improving the limit of breaking strength due to the local high temperature (temperature increase at the empty heating portion) of the head portion 10*a* as well as improving the durability and reliability. Additionally, thermal efficiency is improved by allowing heat generated from the head portion 10*a* to be not easily released as well as the response is improved by reducing the heat accumulation amount of the head portion 10*a* to realize the thermal head 10 which is capable of performing printing at high speed while saving power.

Figure 5:
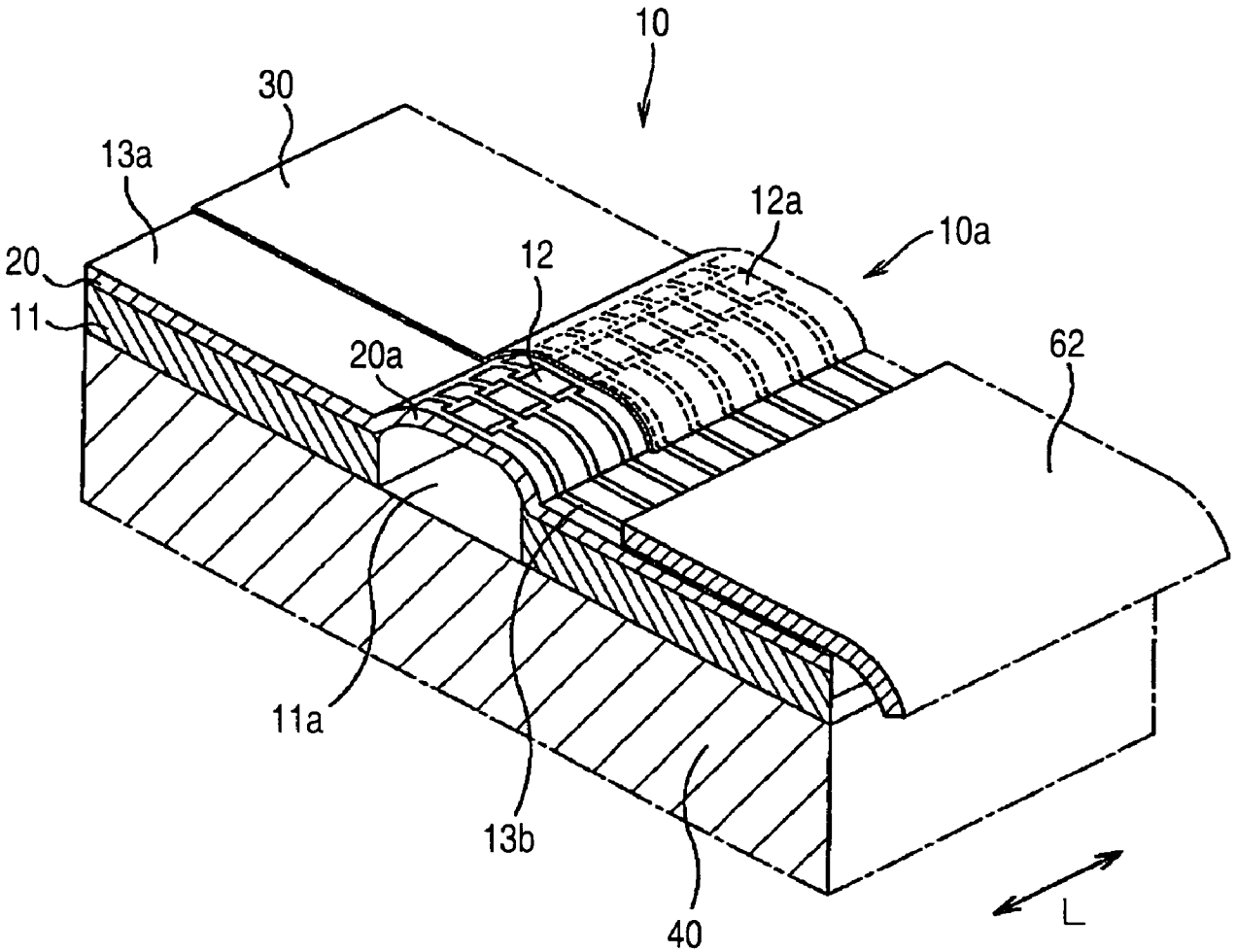
FIG. 5 is a perspective view partially showing the thermal head according to the first embodiment.

FIG. 5 is a perspective view partially showing the thermal head 10 according to the first embodiment.

Figure 6:
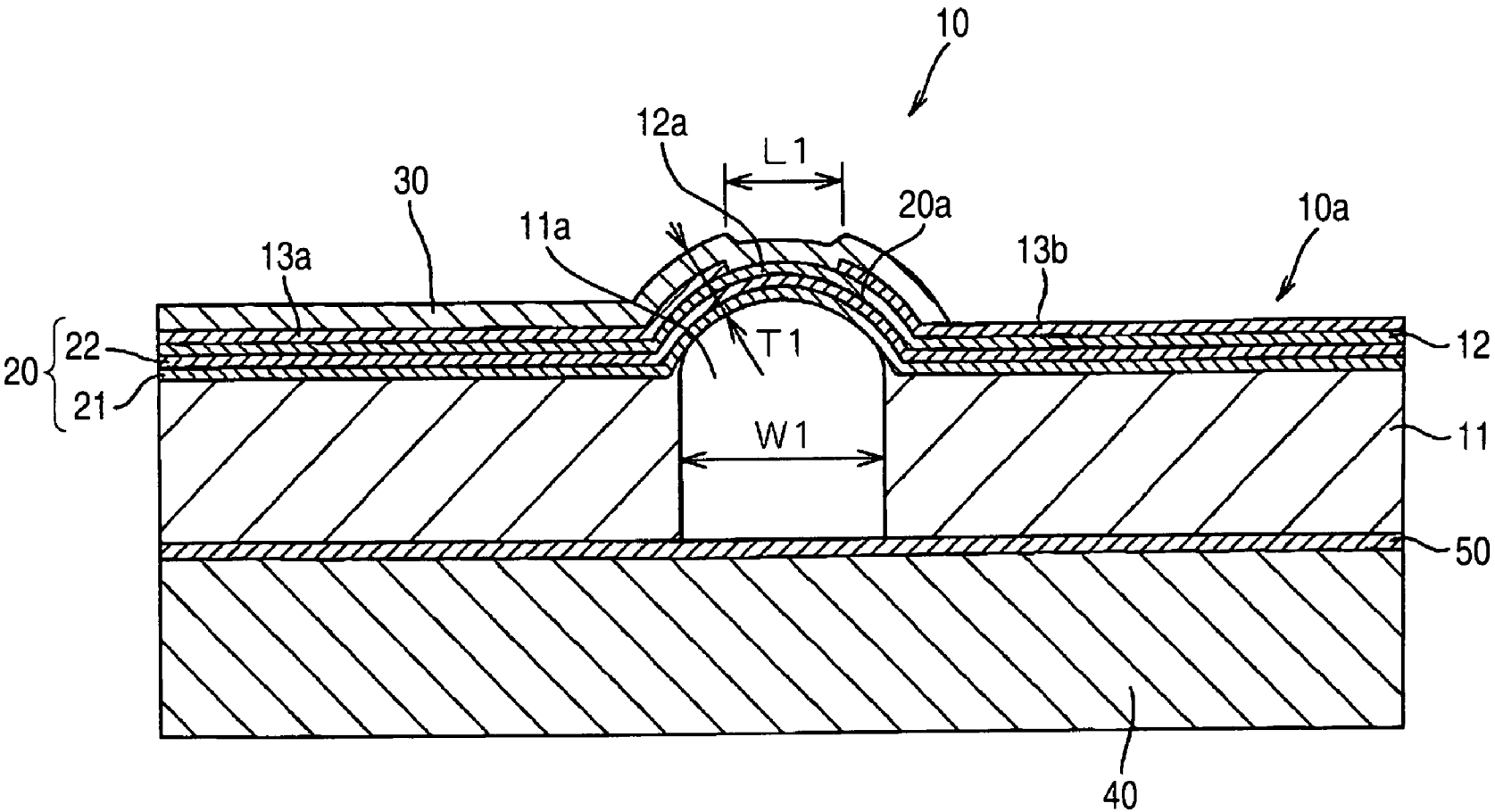
FIG. 6 is a longitudinal sectional view showing the thermal head according to the first embodiment.

FIG. 6 is a longitudinal sectional view showing the thermal head 10 according to the first embodiment.

As shown in FIG. 5 and FIG. 6, the head portion 10*a* of the thermal head 10 includes a glass substrate 11 (which corresponds to a support substrate according to an embodiment of the invention), a glaze layer 20 provided on the glass substrate 11, heating resistive elements 12 (which correspond to heating elements according to an embodiment of the invention) arranged on the glaze layer 20, a power supply electrode 13*a* and drive electrodes 13*b* for heating the heating resistive elements 12, and a protective film 30 provided over the heating resistive elements 12, the power supply electrode 13*a* and the drive electrodes 13*b*. The heatsink 40 is adhered to the head portion 10*a* by an adhesive 50 (refer to FIG. 6) to form the thermal head 10.

In the head portion 10*a*, the flexible substrates for power supply 61 are electrically connected to the power supply electrode 13*a* through the ACF (anisotropic conductive film) for generating thermal energy from the heating resistive elements 12. Also, flexible substrates for driving 62 (refer to FIG. 5) are electrically connected to the drive electrodes 13*b* through the ACF.

The glass substrate 11 is a support substrate of the head portion 10*a*, for example, formed to be a rectangle by glass having a softening point of approximately 500° C. and a rate of thermal conductivity of approximately 1 W/mK. In the glass substrate 11, a concave gap portion 11*a* is formed. The glass substrate 11 is made of a material having prescribed surface property, thermal characteristics and the like as represented by glass, however, the support substrate according to an embodiment of the invention is not limited to the glass substrate 11, and it is preferable to apply support substrates made of synthetic jewels such as artificial crystal, artificial ruby and artificial sapphire, an artificial stone, high-density ceramics and the like.

The glaze layer 20 includes a protruding portion 20*a* on which the heating resistive elements 12 are arranged. The protruding portion 20*a* is formed to have an approximately arc shape in longitudinal section at the center of the width direction as well as the longitudinal direction (direction of an arrow L in FIG. 5) in the glaze layer 20. Accordingly, a surface facing the ink ribbon 3 (refer to FIG. 2) is the arc-shaped protruding portion 20*a*, and the heating resistive elements 12 arranged on the protruding portion 20*a* fit to the ink ribbon 3 suitably. As a result, thermal energy generated by the heating resistive elements 12 can be efficiently transmitted to the ink ribbon 3.

The glaze layer 20 includes a base layer 21 stacked on the glass substrate 11, forming a ceiling surface of the gap portion 11*a* and a heat resistant layer 22 stacked on the base layer 21, on which heat resistive elements 12 are arranged as shown in FIG. 6. The base layer 21 is made of Au (gold) and the heat resistant layer 22 is made of a silicon nitride material. As the silicon nitride materials, for example, engineering ceramics represented by a chemical formula of SiAlON is preferable, which includes four elements of Si (silicon), Al (aluminum), O (oxygen) and N (nitrogen), in which an Al (aluminum) atomic element substitutes for a part of a Si (silicon) atomic element and an O (oxygen) atomic element substitutes for a part of a N (nitrogen) atomic element.

The heating resistive elements 12 generate thermal energy, which are arranged on the protruding portion 20*a* of the glaze layer 20 as described above. The heating resistive elements 12 are made of a material whose resistance value increases as the temperature increases (material whose temperature dependence of the resistance value has a positive characteristic) such as Ta (tantalum) —$SiO_2$ (silicon dioxide) or Nb (niobium) —$SiO_2$ (silicon dioxide). A portion in the heating resistive element 12 exposed between the power supply electrode 13*a* and the drive electrode 13*b* will be a heating portion 12*a* which actually generates thermal energy, which is arranged on the protruding portion 20*a* to be a rectangle having a length L1. The heating portion 12*a* is formed to be larger than a dot size of ink to be transferred for dispersing generated thermal energy.

The reason that the material whose temperature dependence of the resistant value has the positive characteristic is used as the heating resistive elements 12 is for suppressing abnormal temperature increase of the heating portions 12*a* by itself. Specifically, materials commonly used in the past are materials having no temperature dependence or less dependence. However, when the temperature dependence has the positive characteristic, for example, if the temperature increases in the empty heating portion (refer to FIG. 4), the resistance value also increases, therefore, electric current flowing in the heating resistive elements 12 is decreased. Accordingly, the heating value is also decreased and the temperature increase at the empty heating portion is suppressed by itself. As a result, permanent change of the resistive value caused by the temperature increase and breaking limit are improved, which improves durability and reliability.

At the beginning of power application to the heating resistive elements 12, since generated heat is absorbed in the periphery, it is difficult to realize rapid temperature increase, therefore, an image will be the one without sharpness. This status is the same when performing printing which requires rapid temperature change. However, in the case that the material whose temperature dependence of the resistive value has the positive characteristic is used, as the temperature increases by the start of power application, the resistive value of the heating resistive elements 12 also increases and large electric power is applied. As a result, the heating value increases as well as rising characteristics of temperature increase are improved.

The power supply electrode 13*a* and the drive electrodes 13*b* supply electric current from the power supply to the heating resistive elements 12 as well as drive the heating resistive elements 12 to heat the heating portions 12*a*. The power supply electrode 13*a* and the drive electrodes 13*b* are made of a material having good electric conductivity such as Al (Aluminum), Au (gold) or Cu (copper). As shown in FIG. 5, the power supply electrode 13*a* is a common electrode which is electrically connected to all heating resistive elements 12, and the drive electrode 13*b* is an individual electrode individually connected to each heating resistive element 12.

The power supply electrode 13*a* (common electrode) is provided at an opposite side to the side in which the flexible substrates for power supply 61 (refer to FIG. 3) are adhered, interposing the protruding portion 20*a* of the glaze layer 20. Both sides of end portions are led to the direction of the flexible substrates 61 along a short edge of the glass substrate 11, connected to the flexible substrates for power supply 61 electrically through the ACF (anisotropic conductive film). Therefore, the power supply electrode 13*a* is connected to the power supply through the flexible substrates for power supply 61 and electric current is supplied to all heating resistive elements 12.

Furthermore, the drive electrode 13*b* (individual electrode) is provided on the side in which the flexible substrates for driving 62 are adhered, interposing the protruding portion 20*a* of the glaze layer 20. The drive electrodes 13*b* are electrically connected to the flexible substrates for driving 62 connected to a control circuit controlling the drive of the heating resistive elements 12 through the ACF (anisotropic conductive film). Accordingly, electric current is supplied to selected heating resistive elements 12 by the control circuit for a certain period of time, thereby heating the heating portions 12*a* of the heating resistive elements 12, and ink of the ink ribbon 3 (refer to FIG. 2) is sublimed by the thermal energy to increase the temperature in which the ink is transferred on the printing paper 2 (refer to FIG. 2).

Further, the power supply electrode 13*a* and the drive electrodes 13*b* are connected to the flexible substrates for power supply 61 (refer to FIG. 3) and the flexible substrates for driving 62 (refer to FIG. 5) through the ACF (anisotropic conductive film) made of an insulating resin material, therefore, heat generated at the heating portions 12*a* is prevented from being released in the directions of the flexible substrates for power supply 61 and the flexible substrates for driving 62 through the power supply electrode 13*a* and the drive electrode 13*b*. Therefore, useless heat release of heat generated from the heating portions 12*a* is suppressed and thermal efficiency is improved.

The protective film 30 is provided at the most outside of the head portion 10*a*. The protective film 30 protects the heating portions 12*a* and the like from the friction and the like when the head portion 10*a* abuts on the ink ribbon 3 (refer to FIG. 2) by covering the heating resistive elements 12 (heating portions 12*a*), the power supply electrode 13*a* and the drive electrodes 13*b*. Materials including sliding property and abrasion resistance are used for the protective film 30, for example, SiAlON is preferable in the same manner as the heat resistant layer 22 in the glaze 20.

In the head portion 10*a*, the gap portion 11*a* is formed in the glass substrate 11 so as to face the protruding portion 20*a*. Specifically, the gap portion 11*a* faces the protruding portion 20*a* on which the heating resistive elements 12 are arranged in the longitudinal direction (in an arrow L in FIG. 5) of the thermal head 10, which is formed to be a concave shape toward the heating portions 12*a* of the heating resistive elements 12. As shown in FIG. 6, the base layer 21 forming the lower layer of the glaze layer 20 becomes the ceiling surface of the gap portion 11*a*. Therefore, there is not the glass substrate 11 at the ceiling surface of the gap portion 11*a*, and the gap portion 11*a* has a space extending to the undersurface of the base layer 21. Additionally, a thickness T1 of the protruding portion 20*a* (an upper area of the gap portion 11*a*) which will be a heat accumulation portion in which thermal energy generated from the heating portions 12*a* is accumulated becomes thinner (the thickness becomes just the thickness T1 of the glaze layer 20).

Here, the width W1 of the gap portion 11*a* is formed so as to be the same as the length L1 of the heating portion 12*a* or larger than the length L1 for improving the thermal efficiency of the thermal head 10. Specifically, when the width W1 of the gap portion 11*a* is larger, namely, larger than the length L1 of the heating portion 12*a*, the amount of air in the gap portion 11*a* is increased to suppress the heat release to the glass substrate 11 efficiently due to a characteristic of air which has the thermal conductivity lower than glass, and it becomes difficult to release thermal energy generated from the heating portions 12*a* to the glass substrate 11. As a result, thermal energy in the direction of the ink ribbon 3 (refer to FIG. 2) can be increased to thereby improve thermal efficiency of the thermal head 10.

Additionally, the protruding portion 20*a* is thin, having the thickness of only the thickness T1 of the glaze layer 20 due to the gap portion 11*a*, therefore, the heat accumulation amount is small. Accordingly, since thermal energy can be released in a short period of time, the temperature of the thermal head 10 can be immediately decreased when the heating portions 12*a* are not heated. As a result, response of the thermal head 10 is improved and high quality images or characters can be printed while saving power at high speed without generating disadvantages such as blur of images or characters.

Furthermore, in the glaze layer 20, the heat resistant layer 22 at the protruding portion 20*a* will be the heat accumulation portion of thermal energy generated from the heating portions 12*a*. Owing to thermal energy accumulated in the protruding portion 20*a*, it is possible to immediately increase the temperature to a sublimation temperature of ink while saving power when the ink is transferred on the printing paper 2 (refer to FIG. 2). As a result, thermal efficiency of the thermal head 10 is further improved.

As described above, the protruding portion 20*a* just under the heating portions 12*a* becomes the heat accumulation portion in the glaze layer 20, which is exposed to high temperature. Also, in the empty heating portion (refer to FIG. 4), the temperature of the glaze layer 20 locally increases. Accordingly, the high heat resistance is necessary in the glaze layer 20, therefore, the heat resistant layer 22 of the glaze layer 20 is made of a silicon nitride material (for example, SiAlON (sialon)).

Figure 11:
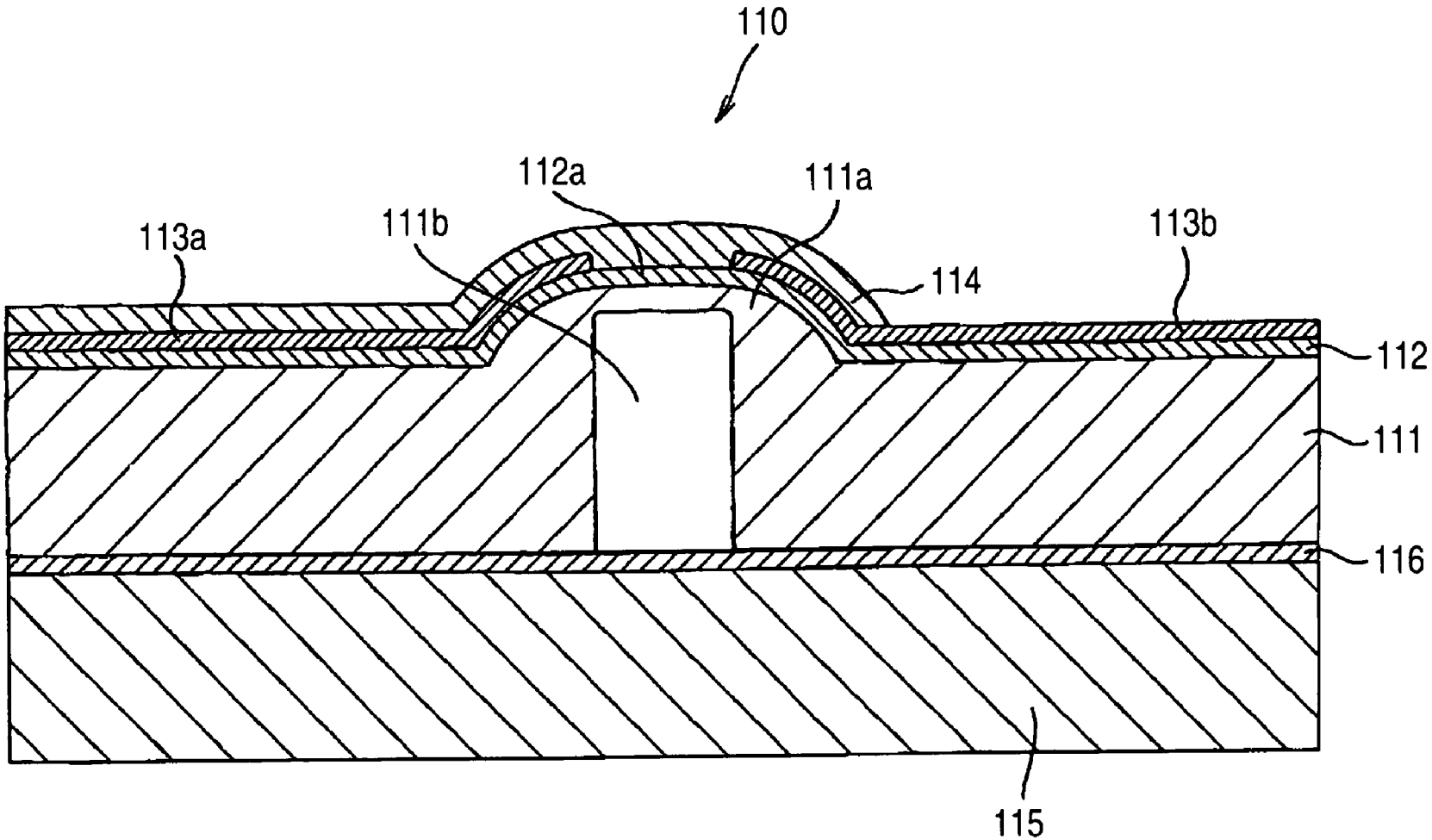
FIG. 11 is a longitudinal sectional view showing a thermal head in related art.

The silicon nitride material forming the heat resistant layer 22 has excellent heat resistance and high degree of hardness. Particularly, SiAlON (sialon) has high strength under high temperature, which is excellent in abrasion resistance, heat resistance thermal-shock resistance, thermal conductivity and the like. Therefore, as compared with the case in which the protruding portion 111*a* in the glass substrate 111 is the heat accumulation portion and the heat resistance is limited by characteristics possessed by a glass (a glass transition point, a deformation point, a softening point and the like) as in the thermal head 110 in related art (refer to FIG. 11), the heat resistance can be drastically improved, therefore, the limit of breaking strength of the glaze layer 20 due to high temperature can be improved.

Additionally, the protruding portion 20*a* of the glaze layer 20 has the gap portion 11*a* thereunder, and the ceiling surface of the gap portion 11*a* is made of the base layer 21 so as to be thin as far as possible (just the thickness T1 of the glaze layer 20) in order to reduce the heat accumulation amount. Accordingly, it is necessary to increase the degree of hardness of the protruding portion 20*a*. The heat resistant layer 22 of the glaze layer 20 is made of the silicon nitride material (for example, SiAlON (sialon)) to thereby increase the degree of hardness of the glaze layer 20, which improves the limit of breaking strength in the thin protruding portion 20*a*.

Furthermore, in the protruding portion 20*a* of the glaze layer 20, the base layer 21 has an approximately arc-shape at the ceiling surface of the gap portion 11*a* along the vertical section of the protruding portion 20*a* having the approximately arc shape. Therefore, when the protruding portion 20*a* is pressed on the printing paper 2 (refer to FIG. 2) through the ink ribbon 3 (refer to FIG. 2), stress is not concentrated on a portion of the glaze layer 20 positioned at corner portions at both ends of the gap portion 11*a*, which increases the physical strength of the glaze layer 20. As a result, the thickness T1 of the protruding portion 20*a* can be made extremely thin.

In addition, the glass substrate 11 is formed to be the approximately arc shape also in the corner portions at both ends of the gap portion 11*a*. Therefore, pressure acted on the gap portion 11*a* of the glass substrate 11 from the direction of the protruding portion 20*a* is dispersed and the physical strength of the glass substrate 11 is increased. As a result, deformation or damage of the glass substrate 11 can be prevented even when the width W1 of the gap portion 11*a* is widened.

Furthermore, the protruding portion 20*a* of the glaze layer 20 has the uniform thickness T1 on the gap portion 11*a* of the glass substrate 11. Specifically, the base layer 21 and the heat resistant layer 22 in the glaze layer 20 have fixed thicknesses respectively, the thickness of the heat resistant layer 22 just under the heating portions 12*a* in which thermal energy is accumulated is uniform. Therefore, thermal balance is good as well as thermal efficiency and response of the thermal head 10 will be also good.

Figure 7A:
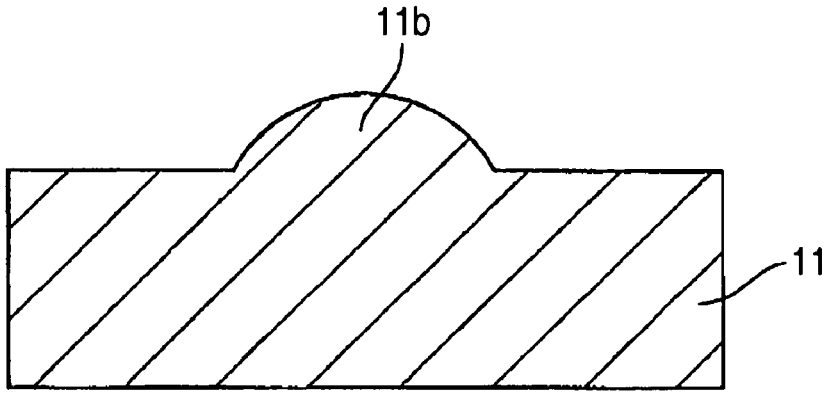
FIG. 7A and FIG. 7B are sectional views showing a process of forming a substrate and a process of forming a base layer in a manufacturing method of the thermal head according to the first embodiment.
Figure 7B:
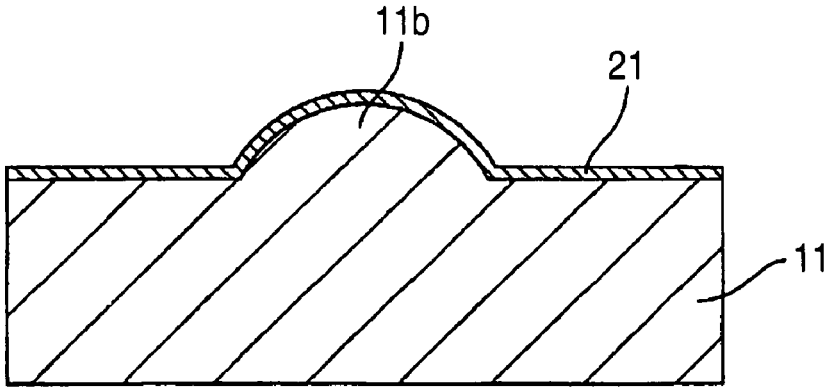

FIG. 7A and FIG. 7B are sectional views showing a process of forming the substrate and a process of forming the base layer in a manufacturing method of the thermal head 10 according to the first embodiment.

Figure 8A:
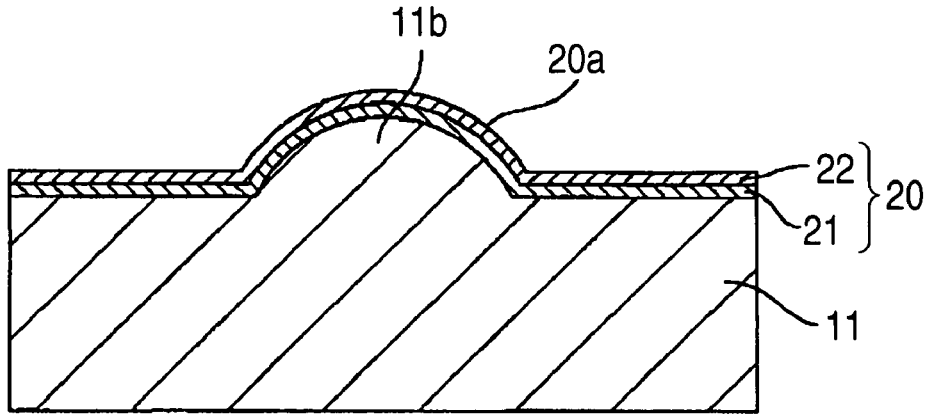
FIG. 8A and FIG. 8B are sectional views showing a process of forming a heat resistant layer and a process of forming a heating portion in the manufacturing method of the thermal head according to the first embodiment.
Figure 8B:
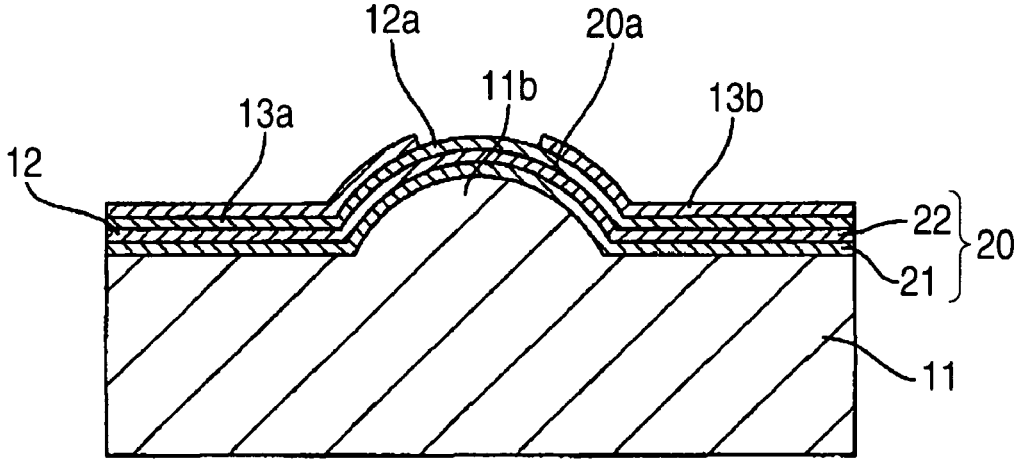

FIG. 8A and FIG. 8B are sectional views showing a process of forming the heat resistant layer and a process of forming the heating portion in the manufacturing method of the thermal head 10 according to the first embodiment.

Figure 9A:
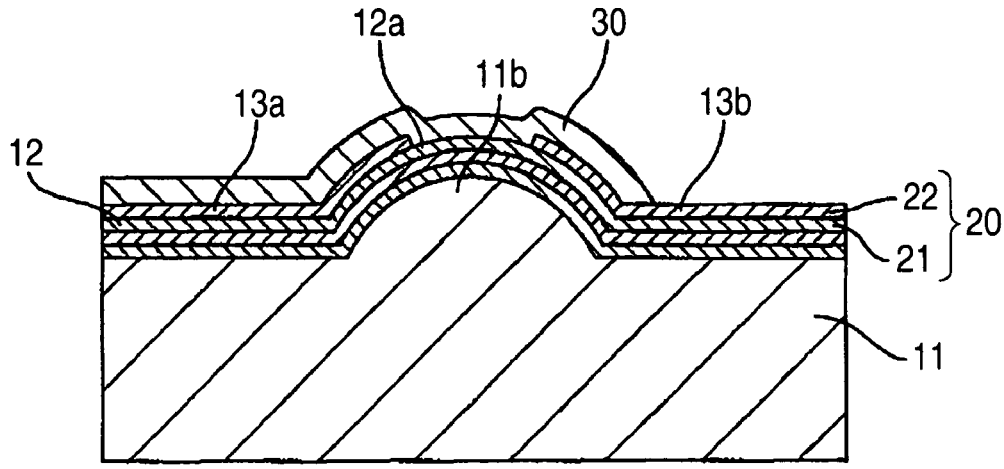
FIG. 9A and FIG. 9B are sectional views showing a process of forming a protection film and a process of forming a gap portion in the manufacturing method of the thermal head according to the first embodiment.
Figure 9B:
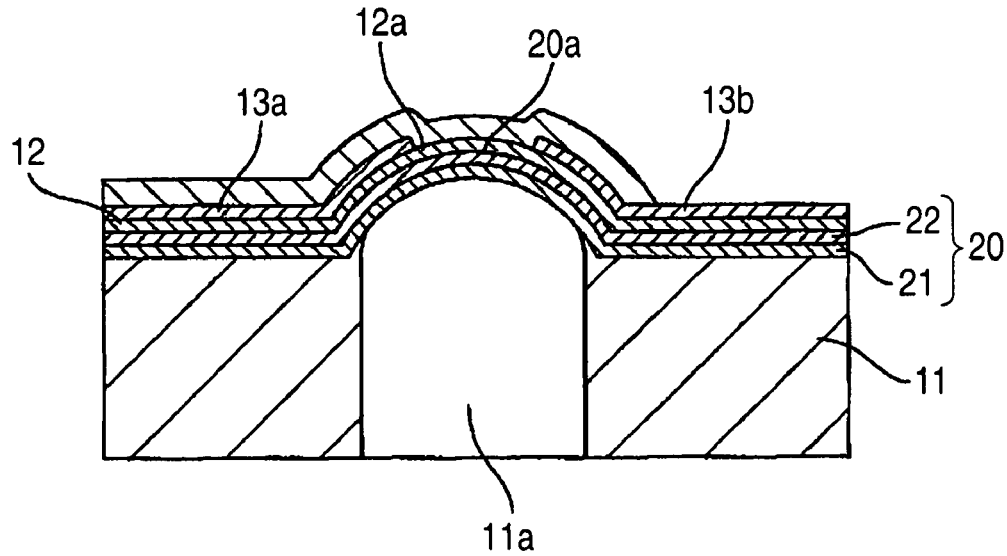

Furthermore, FIG. 9A and FIG. 9B are sectional views showing a process of forming the protection film and a process of forming the gap portion in the manufacturing method of the thermal head 10 according to the first embodiment.

In order to manufacture the thermal head 10 (refer to FIG. 6) according to the first embodiment, first, glass which is a raw material for the glass substrate 11 is prepared, and thermal press and the like are performed on the glass to form the glass substrate 11 having a prescribed size including a protrusion 11*b* (the process of forming the substrate) as shown in FIG. 7A. The protrusion 11*b* is a base for the protruding portion 20*a* (refer to FIG. 6), having an approximately arc shape in vertical section.

Next, as shown in FIG. 7B, the base layer 21 to be a lower layer of the glaze layer 20 (refer to FIG. 6) is formed on the glass substrate 11 having the protrusion 11*b* (the process of forming the base layer). In this process, the base layer 21 is made of Au (gold) in the thermal head 10 according to the first embodiment, therefore, an Au (gold) film is deposited on a surface of the glass substrate 11 by a thin-film forming technique such as sputtering in the process of forming the base layer shown in FIG. 7B.

After that, as shown in FIG. 8A, the heat resistant layer 22 to be an upper layer of the glaze layer 20, on which the heating resistive elements 12 (refer to FIG. 6) are arranged is formed on the base layer 21 (Au (gold) film) (the process of forming the heat resistant layer). In this process, the heat resistant layer 22 is made of a silicon nitride material (SiAlON (sialon)) in the thermal head 10 according to the first embodiment, therefore, a SiAlON (sialon) film is deposited on a surface of the base layer 21 (Au (gold) film) by sputtering and the like in the process of forming the heat resistant layer shown in FIG. 8A.

As described above, when the heat resistant layer 22 (SiAlON film) is stacked on the base layer 21 (Au (gold) film) to form the glaze layer 20, the protruding portion 20*a* of the glaze layer 20 is formed on the protrusion 11*b*. Then, as shown in FIG. 8B, the heating portion 12*a* is formed (process of forming the heating portion). Specifically, first, a resistive element film to be the heating resistive element 12 is formed. In the process, the heating resistive element 12 is made of a material (Ta (tantalum) —$SiO_2$ (silicon dioxide)) whose resistive value increases as temperature increases in the thermal head 10 according to the first embodiment, therefore, in the process of forming the heating portion shown in FIG. 8B, the resistive element film made of Ta (tantalum) —$SiO_2$ (silicon dioxide) is pattern formed on a surface of the glaze layer 20 (resistant layer 22) by a technique such as photolithography.

Next, a conductive layer (a material having good electric conductivity such as Al (aluminum)) on the heating resistive element 12 (Ta (tantalum) —$SiO_2$ (silicon dioxide) film) is pattern formed by the technique such as photolithography to form the power supply electrode 13*a* and the drive electrode 13*b*. In the process, the heating resistive element 12 is exposed between the power supply electrode 13*a* and the drive electrode 13*b* to form the heating portion 12*a* (a portion in which the heating resistive portion 12 is exposed between the power supply electrode 13*a* and the drive electrode 13*b* will be the heating portion 12*a* which actually generates thermal energy). In a portion in which the heating resistive element 12, the power supply electrode 13*a* and the drive electrode 13*b* are not formed, the glaze layer 20 (heat resistant layer 22) is exposed as it is.

As shown in FIG. 9A, a SiAlON (sialon) film is formed over the heat resistive element 12 (heating portion 12), the power supply electrode 13*a*, the drive electrode 13*b* and the exposed glaze layer 20 by sputtering and the like to form the protective film 30 (the process of forming the protective film). The SiAlON (sialon) which is the same as the heat resistant layer 22 is used for the protective film 30, therefore, component materials can be reduced. Then, as shown in FIG. 9B, the concave gap portion 11*a* is formed on the glass substrate 11 at a portion facing the protruding portion 20*a* (the process of forming the gap portion).

In the process of forming the gap portion, first, an approximately concave shape which is close to the gap portion 11*a* is formed by machining such as cutting by a cutter. After that, etching processing by hydrofluoric acid is performed to remove cracks (microcracks) in the inner surface to which cutting was performed as well as to adjust the shape of the gap portion 11*a*, thereby forming the grass substrate 11 in corner portions on both sides of the gap portion 11*a* to be the approximately arc shape. Further, the base layer 21 which is the lower layer of the glaze layer 20 is exposed by etching processing by hydrofluoric acid to form the gap portion 11*a* in a final state, in which the base layer 21 is the ceiling surface thereof. The process of forming the gap portion is performed after the process of forming the base layer, which can be performed before the process of forming the heating portion.

As described above, the etching processing by hydrofluoric acid is performed in the process of forming the gap portion, and the base layer 21 functions as a barrier for stopping the etching. Specifically, the etching by the hydrofluoric acid is stopped at the Au (gold) film which is the base layer 21. Therefore, the thickness T1 of the protruding portion 20*a* (refer to FIG. 6) is defined by the thickness of the glaze layer 20 (film thickness of the Au (gold) film as the base layer 21+film thickness of the SiAlON (sialon) film as the heat-resistant film 22).

Consequently, it is possible to form the protruding portion 20*a* which is uniformly thin and has high accuracy as well as to form the gap portion 11*a* which has excellent processing accuracy and has no microcracks and the like. Specifically, the accuracy of the protruding portion 20*a* and the gap portion 11*a* (dimension accuracy and processing accuracy) is improved as compared with the case of forming the gap portion 11*a* by mechanical methods such as cutting, therefore, not only the limit of breaking strength of the protruding portion 20*a* is improved but also fluctuation of the heat accumulation amount is suppressed, as a result, excellent image quality can be obtained.

Finally, the heatsink 40 (refer to FIG. 6) is adhered to the back of the glass substrate 11 so as to close an opening surface of the gap portion 11*a* to form the thermal head 10 according to the first embodiment shown in FIG. 6. The adhesion of the heat sink 40 is performed by coating the adhesive 50 (refer to FIG. 6) at the surface of the heatsink 40 and pressing the glass substrate 11 from the above. The adhesive 50 is made of materials having elasticity and thermal conductivity (for example, a heat-curing silicon rubber and the like), which includes a filler having high degree of hardness and thermal conductivity (for example, granular or linear $Al_2O_3$ (aluminum oxide) and the ike).

Accordingly, the adhesive 50 has thermal conductivity, thereby releasing heat in the glass substrate 11 side efficiently to the heatsink 40. The shear force due to the difference of thermal expansion coefficient between the glass substrate 11 and the heatsink 40 is absorbed by the thickness of the adhesive 50 (for example, approximately 50 μm), therefore, the heatsink 40 is not peeled.

Figure 10:
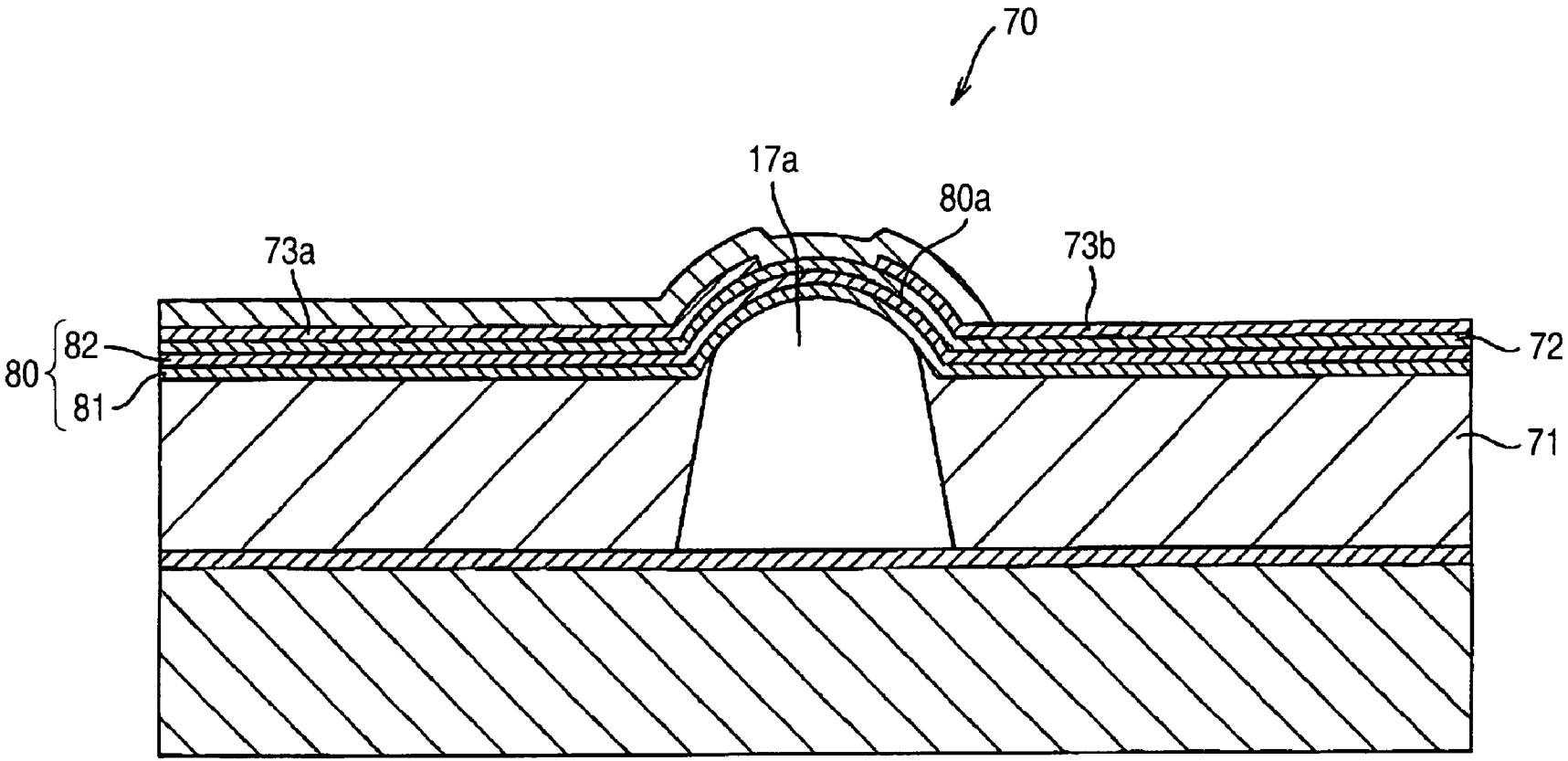
FIG. 10 is a longitudinal sectional view showing a thermal head according to a second embodiment.

FIG. 10 is a longitudinal sectional view showing a thermal head 70 according to a second embodiment.

As shown in FIG. 10, the thermal head 70 according to the second embodiment is formed so that a vertical section of a gap portion 71*a* has a shape in which the side of an opening surface is wider than the other side. Specifically, the thermal head 70 according to the second embodiment has a glass substrate 71 in which the protrusion 11*b* (refer to FIGS. 7A and 7B) to be a base of a protruding portion 80*a* is formed by thermally pressing glass at the time of manufacturing as well as an approximately concave shape close to the gap portion 71*a* is formed.

Therefore, in the thermal head 70 according to the second embodiment, the approximately concave shape to be the gap portion 71*a* is formed by thermal press molding at the same time as the protrusion 11*b* (refer to FIG. 7) is formed, therefore, the process of forming the concave shape by the post-process such as cutting is not necessary. Also, in this process, the side of the opening surface of the concave shape is formed to be wider, thereby making the mold release of the thermal head easy after the thermal press molding. Then, a base layer 81 of a glaze layer 80 is formed on the glass substrate 71 (a process of forming the base layer) as well as a heat resistant layer 82 is formed on the base layer 81 (a process of forming the heat resistant layer). Further, after forming a heat resistive element 72, a power supply electrode 73*a*, a drive electrode 73*b* and a protective film 74 are sequentially formed, the base layer 81 is exposed by etching processing by hydrofluoric acid to thereby form the gap portion 71*a* in a final state which faces the protruding portion 80*a* and whose ceiling surface is the base layer 81 (a process of forming the gap portion).

As described above, in the thermal head 10 according to the first embodiment and the thermal head 70 according to the second embodiment, the glaze layer 20 (glaze layer 80) includes the base layer 21 (base layer 81) and the heat resistant layer 22 (heat resistant layer 82). The base layer 21 (The base layer 81) forms the ceiling surface of the gap portion 11*a* (gap portion 71*a*). Therefore, the protruding portion 20*a* (protruding portion 80*a*) on which the heating resistive elements 12 (heating resistive elements 72) are arranged can be formed with high accuracy (dimension accuracy and processing accuracy) to be uniformly thin while keeping the strength, as a result, fluctuation of the heat accumulation amount can be suppressed. Further, since the gap portion 11*a* (gap portion 71*a*) can be formed to be large, useless heat release is suppressed. Consequently, thermal efficiency and response become excellent, and high quality images or characters can be printed at high speed while saving power.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal head which forms an image on a recording medium by pressing a protruding portion on which heating elements are arranged on the recording medium while driving the heating elements to be heated, comprising:

a support substrate in which a concave gap portion facing the protruding portion is formed; and a glaze layer provided on the support substrate and in which the protruding portion is formed, and wherein the glaze layer includes a base layer stacked on the support substrate as well as forming a ceiling surface of the gap portion, and a heat resistant layer stacked on the base layer and on which the heating elements are arranged.

2. The thermal head according to claim 1, wherein the support substrate is made of glass, the base layer in the glaze layer is made of Au (gold) and the heat resistant layer in the glaze layer is made of a silicon nitride material.

3. The thermal head according to claim 1, wherein the protrusion portion has a uniform thickness over the gap portion.

4. The thermal head according to claim 1, wherein the heating elements are made of a material whose resistive value increases as a temperature of the heating elements increases.

5. A thermal printer, comprising;

a thermal head which forms an image on a recording medium by pressing a protruding portion on which heating elements are arranged on the recording medium while driving the heating elements to be heated, and wherein the thermal head includes a support substrate in which a concave gap portion facing the protruding portion is formed, and a glaze layer provided on the support substrate and in which the protruding portion is formed, and wherein the glaze layer includes a base layer stacked on the support substrate as well as forming a ceiling surface of the gap portion, and a heat resistant layer stacked on the base layer and on which the heating elements are arranged.

6. A manufacturing method of a thermal head having a glaze layer on a support substrate, in which a protruding portion on which heating elements are arranged is formed, which forms an image on a recording medium by pressing the protruding portion on which the heating elements are arranged on the recording medium while driving the heating elements to be heated, comprising the steps of:

forming a base layer to be a lower layer in the glaze layer on the support substrate including a protrusion corresponding to the protruding portion;

forming a heat resistant layer on the base layer formed in the step of forming the base layer, which is to be an upper layer in the glaze layer and on which the heating elements are arranged; and forming a concave gap portion facing the protruding portion and whose ceiling surface is the base layer on the support substrate by exposing the base layer on the protrusion after forming the base layer in the step of forming the base layer.

7. The manufacturing method of the thermal head according to claim 6, wherein, in the step of forming the base layer, the base layer made of Au (gold) is formed on the support substrate made of glass, wherein, in the step of forming the heat resistant layer, the heat resistant layer made of a silicon nitride material is formed on the base layer, and wherein, in the step of forming the gap portion, the base layer on the protrusion is exposed by etching processing by hydrofluoric acid.

* * * * *